United States Patent [19]

Hair

[11] Patent Number: 4,973,192

[45] Date of Patent: Nov. 27, 1990

[54] INTERLOCKING PAVING STONE AND GROUND COVER FORMED THEREOF

[76] Inventor: Roberta A. Hair, 7554 Wooster Rd., Cincinnati, Ohio 45227

[21] Appl. No.: 497,439

[22] Filed: Mar. 22, 1990

[51] Int. Cl.[5] ..... E01C 5/00

[52] U.S. Cl. ..... 404/34; 404/41; 404/42

[58] Field of Search ..... 404/29, 34, 37–42; 52/311, 313, 590, 608

[56] References Cited

U.S. PATENT DOCUMENTS

| | | | |
|---|---|---|---|
| D. 86,076 | 1/1932 | Bolton | D25/138 |
| D. 187,739 | 4/1960 | Yacura | D25/161 |
| 3,214,874 | 11/1965 | Roberts | 52/590 X |
| 3,931,700 | 1/1976 | Scanni et al. | 52/590 |
| 4,125,341 | 11/1978 | Reinschutz | 404/41 |
| 4,128,357 | 12/1978 | Barth et al. | 404/41 |
| 4,544,305 | 10/1985 | Hair | 404/34 X |

FOREIGN PATENT DOCUMENTS

| | | | |
|---|---|---|---|
| 132505 | 3/1933 | Austria | 404/40 |
| 58352 | 7/1938 | Denmark | 404/41 |
| 218537 | 4/1987 | European Pat. Off. | 404/41 |
| 3216082 | 11/1983 | Fed. Rep. of Germany | 404/41 |
| 2365659 | 9/1976 | France | 404/41 |
| 296984 | 5/1932 | Italy | 404/41 |
| 373044 | 8/1939 | Italy | 404/41 |
| 439736 | 9/1948 | Italy | 52/590 |
| 558115 | 2/1957 | Italy | 404/41 |
| 69315 | 1/1952 | Netherlands | 404/41 |
| 8502872 | 7/1985 | PCT Int'l Appl. . | |
| 244655 | 12/1925 | United Kingdom . | |
| 800275 | 1/1981 | U.S.S.R. | 404/34 |

*Primary Examiner*—Stephen J. Novosad
*Assistant Examiner*—Gay Ann Spahn
*Attorney, Agent, or Firm*—Wood, Herron & Evans

[57] ABSTRACT

A paving material includes a plurality of identical paving stones which are similarly oriented and interlock to form a ground cover which completely covers the ground without being combined with stones of other shapes. The shape of the stones is defined by an array of concentric circle pairs centered at the intersections of two sets of parallel and equally spaced lines. The circles intersect so as to form two shapes, one shape being a segment of a solid cylinder with a radius that of the inner circle and the other being a segment of an open annular ring lying between an inner and an outer circle. Each stone includes one of the solid cylindrical segments integrally joined with one or two parts of an annular segment. Optionally, a false joint is marked by an arcuate groove in the upper surface of each stone.

30 Claims, 5 Drawing Sheets

INTERLOCKING PAVING STONE AND GROUND COVER FORMED THEREOF

The present invention relates to slab elements and paving stones for covering horizontal areas such as the ground and, more particularly, to interlocking curvilinear paving stones and ground cover patterns formed thereof.

BACKGROUND OF THE INVENTION

Paving stones of the type to which the present invention relates are manufactured slab or paving elements usually molded of ceramic material, most commonly concrete, into predetermined shapes which, when arranged in a pattern, form a covering for the ground or other surface area which is generally intended to bear pedestrian or vehicular traffic.

Bricks, cut stones and slab elements of various types have long been used to cover roads and walkways to form a pavement or ground cover arrangement. In forming the ground cover pattern, the elements are preferably laid adjacent each other in an array to fully cover the area being paved. The most common shape of element used historically is the rectangular brick like shape which can easily be arranged to fully cover the ground without resort to combinations of stones of different sizes or shapes to do so. Such elements are laid with or without grout or mortar joints which rigidly join one element with another.

A type of ground cover finding increasing use is that formed of the paving stones laid without mortar or grout, usually with joints filled with particulate material such as sand. The advantages which such ground covers present are an ability to tolerate movement and deformation without exhibiting the cracking and breaking which may result with ground covers in which rigid grout or mortar joints are employed.

One disadvantage found with the simple rectangular elements such as bricks and rectangular stones is that, when used with sand or other loose fill joint material, surface water flowing on the pavement area formed of such a ground cover has a tendency to wash the joint material from between the elements. Another disadvantage is that the elements have a tendency to tilt or yield under locally heavy loads.

One solution to both the problem of the washing of joint material from between the elements and to the problem of movement under load has been the introduction of mortarless or groutless paving stones of the interlocking type. Such interlocking paving stones are for example those disclosed in the U.S. Pat. Nos. of Hair 4,544,305 and Barth 4,128,357. An objective in the design of interlocking paving stones, as seen in the Hair and Barth patents, is the creation of shapes which will interlock in such a way as to fully cover the area being paved with a minimum of different stone shapes. It is highly desirable that stones of a single size and shape be capable of forming an interlocking pattern which fully covers the ground. Such a characteristic reduces the number of costly molds and the need for distributors and installers to maintain inventories of different stones. It has also been an objective, difficult in many cases to achieve, to shape the stone in a way that it will not only interlock satisfactorily and form a pattern which fully covers the area being paved, but which will do so with shapes which present boundaries which contribute to a particular aesthetic pattern. By the very nature of the stones, the boundaries which define their shapes make the primary contribution to the overall appearance of the patterns. Unfortunately, not all aesthetically desirable shapes are easily made to interlock effectively. The desire to provide certain shapes in paving stones makes it difficult to design stones which interlock effectively. Thus, the desire to form patterns which yield certain aesthetic effects imposes a constraint on the stone characteristics which preclude the utilitarian properties for which the interlocking stones are desired.

Paving stones of the prior art have generally been of polygonal shapes so that the straight sides will more easily abut those of an adjacent, preferably identical, stone when arranged to from a ground cover pattern. Both the Hair and Barth stones described in the patents identified above are in this category. Shapes with curves have not been successfully developed which form aesthetically acceptable patterns while interlocking in the formation of a pattern to cover the ground. This has been particularly the case with shapes which employ circles and are bounded by circular or cylindrical sides. The Hair stone described above has, as one of its advantages, the ability to provide radial patterns which produce, on a large scale at least, curved and circular appearances. Nonetheless, stones which themselves have prominent curved surfaces capable of influencing the overall patterns of the ground cover have been difficult to design so as to interlock effectively.

Accordingly, there has existed a need for an interlocking paving stone with curvilinear sides which will fully cover the ground with a minimum number of different stone shapes in the pattern.

SUMMARY OF THE INVENTION

It is a primary objective of the present invention to provide a paving stone having a shape defined by curvilinear sides which will form a ground cover pattern with a minimum number of shapes, and which will preferably cover the ground with a stone of a single shape and size. It is a particular objective of the present invention to provide a paving stone having a shape of which a plurality of identically shaped stones may be assembled into an interlocking ground cover pattern which fully covers the area being paved. It is a more particular objective of the present invention to provide such a paving stone with boundaries primarily defined by circles and producing a ground cover having primarily circular appearing texture defined principally by the boundaries of the stone.

According to the principles of the present invention, there is provided a curvilinear paving stone having boundaries defined by the curves of an array of concentric circle pairs. According to the preferred embodiment of the present invention, concentric pairs of circles are arranged in staggered rows in a rectangular array. The areas of the circles are defined so as to overlap in a single common direction upon stones of adjacent rows. The pairs of circles each define an inner circular disk and an outer annular ring. The circles overlap so as to form shapes which are segments of the smaller inner one of the two concentric circles and of the ring formed between the two circles of the concentric pair. Preferably, the rows of circles in the array are spaced three-fourths of the distance between the columns of circles in the rows. A plurality of identical circular sections and a plurality of identical ring sections form the entire pattern. In certain embodiments, the visibility of the boundaries of the stones is enhanced by bevels or grooves.

The stones are formed by one of each such section integrally molded into a single paving stone. The smaller circular section of each stone is joined to the outer edge of the larger disk portion. In certain embodiments, the ring section is divided into two portions, preferably of equal size. Embodiments are provided with and without a false joint or groove to enhance the geometric appearance of the stone in cooperation with the adjacent stones when arranged in a pattern.

Preferably, the sum of the radii of the inner and outer circles equals the spacing of the rows, while the radius of the outer circle $R_2$ is slightly greater than half of the distance between adjacent circles of each row, and preferably approximately equal to the square root of $(X^2+(Y-R_1)^2)$ where X equals the column spacing, Y equals the row spacing, and R equals the radius of the smaller circle.

A ground cover pattern formed by the stones is also provided.

The invention provides the advantages of an interlocking paving stone capable of forming a ground pattern which fully covers the ground with stones of a single size and shape, thus capable of being manufactured from a single mold. The stone presents a curvilinear shape which develops a pattern formed of circles when the stone is formed into a pattern.

These and other objectives and advantages of the present invention will be more readily apparent from the following detailed description of the drawings in which:

DESCRIPTION OF THE DRAWINGS

Referring to FIG. 1, a slab element 20 according to one preferred embodiment of the present invention is illustrated. The slab element 20 is formed as a single integrated piece of ceramic material, preferably a concrete material. Its size is preferably such that it can be installed as a ground cover by a workman laying it in place with one hand and not so as to be so heavy that a workman will unduly tire in a workday. Otherwise, the stone should be as large as possible to minimize the number needed and so that the pattern is apparent. Within these dimensions, the stones will be approximately the size of or slightly larger than, a conventional brick.

The stone 20 is intended to be laid in a horizontal plane as a ground cover with only an upper load bearing surface 21 exposed. The volume of the stone 20 is bounded by the upper surface 21, a lower surface 22 (not visible in FIG. 1) which is a mirror-image of the top surface 21, and a plurality of vertical side surfaces 23–28.

Figure 2:
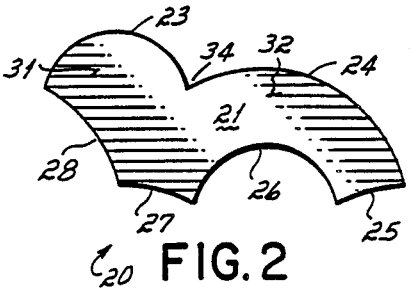
FIG. 2 is a top plan view of the paving stone of FIG. 1.

As can be better understood by reference to the top view of FIG. 2, the side surfaces 23–28 form the closed side boundary of the stone 20. The shape of the vertical sides 23–28 and their intersection with the upper surface 21 generally define the appearance of the stone 20. In addition, the boundaries of the stones, particularly if enhanced with beveled edges, together with any false joint grooves added to the top surface of the stone (as described in connection with FIGS. 4 and 6 below) define the overall pattern of the ground cover formed with patterns of the stones, as described in connection with FIGS. 7–9 below.

Figure 1:
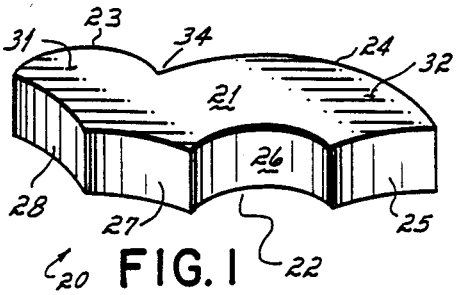
FIG. 1 is a perspective view of a paving stone for covering the ground and the like, according to one embodiment of the present invention, showing the top and inside concave curved side thereof.

In the embodiment shown in FIGS. 1 and 2, all of the sides 23–28 are curved and form, as can be better seen in the top view of FIG. 2, a circular arc, the sides being generally segments of a vertical cylindrical surface, that is, a segment of the surface of a cylinder having a vertical axis. The two side surfaces 23 and 24 are convex while the four side surfaces 25–28 are concave. As will be described more fully in connection with FIGS. 10–12 below, two of the curved side surfaces 23 and 26 are of one radius, while the four curved side surfaces 24, 25, 27 and 28 are of a second radius larger than the first radius of the surfaces 23 and 26, and preferably being approximately twice the radius of surfaces 23 and 26. The circumferential lengths of the arcs of the two smaller radius surfaces 23 and 26 are equal to each other so that the convex surface 23 of one stone will be capable of fitting, when assembled in a pattern with other identical and similarly aligned stones 20, against the concave surface 26 of an adjacent stone 20. Similarly, the length of the circumference of the larger radius convex surface 24 is equal to the combined lengths of the larger radius concave surfaces 25, 27 and 28 such that the surface 24 of stone 20 will be capable of fitting against the adjacent sides 25, 28 and 27 of three different stones 20 (see FIG. 7).

Figure 3:
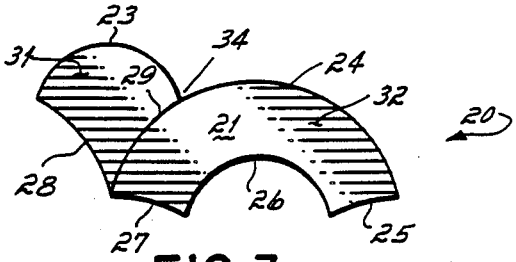
FIG. 3 is a top plan view of the paving stone of FIG. 1 according to an alternative embodiment to that of FIG. 2, which includes a false joint in the top thereof.

FIG. 3 illustrates an alternative embodiment of the stone 20 of FIGS. 1 and 2 wherein the top surface 21 thereof has a groove 29 therein which forms a false joint. The groove or false joint 29 is a circular arc of the same radius, and is an extension of the same circular arc, as the curve of the side 24 of the stone 20. Preferably, the edges formed by the junction of the top surface 21 with the side surfaces 23–28 are each beveled at, for example, an angle of approximately 45° (not shown) to exaggerate the boundaries between adjacent stones rendering them more visible when the stones 20 are assembled in a ground cover pattern. Accordingly, the false joint 29, which may be in the form of a V-groove or other form of groove in the surface 21, forms an extension of the bevel of the curved surfaces 24 and of the curved surfaces 25, 27 and 28 of adjacent stones which will abut the surface 24 when in ground cover formed of the stones 20. As will be seen in connection with the discussion of FIG. 7 below, the surfaces adjacent surface 24 will be the surfaces 25, 27 and 28 of adjacent stones.

The shape of the stone 20 may be further described in terms of two shapes of which it is composed. These shapes include two sections of cylinders, the faces of which can be best seen on the top surface 21 where, in FIG. 3, the surface 21 is divided by the false joint 29 into two sections. These shapes may be defined in terms of the arcs which the side surfaces 23-28 form at the boundary of top surface 21 and the arc of the false joint 29, all as shown in FIG. 3. The circular section 31 may be viewed as a segment of a circular disk bounded by a circle of which the curve defined by the arc of surface 23 forms a part, with those portions removed from it which lie within the areas bounded by the circle on which lies the arc of surface 28, and the circle on which lies the arc of the surface 29. The disk section 32 of surface 21 may similarly be viewed as a segment of an annular disk formed by the area of two concentric circles, an outer circle on which lies the arcs of surface 24 and the false joint 29, and an inner circle on which lies the arc of surface 26. The surface section 32 is the portion of such disk after removing from it portions lying within the two circles on which lie the arcs of surfaces 25 and 27 respectively.

The surface sections 31 and 32 have a common boundary at the false joint 29. Thus, the surface section 31 is a segment of a circle bounded by the arcs of three curved sides, convex side 23, concave side 28 and false joint 29. Similarly, the surface section 32 is a disk segment bounded by the arcs of four sides, a first side being that formed by the arc of concave side surface 24 and false joint 29, a second being that formed by the arc of concave side surface 25, a third side being that formed by the arc of concave side surface 26 and a fourth being that formed by the arc of concave side surface 27.

All of the angles formed by adjacent edges of the two surface sections 31 and 32 are outside corners. The surface 21 which is integrally formed of the two surfaces 31 and 32 has its side surface joined at corners, all of which are outside corners with the exception of the junction of the surfaces 23 and 24, is an inside corner, as illustrated at corner or angle 34 in FIGS. 1-3.

Figure 4:
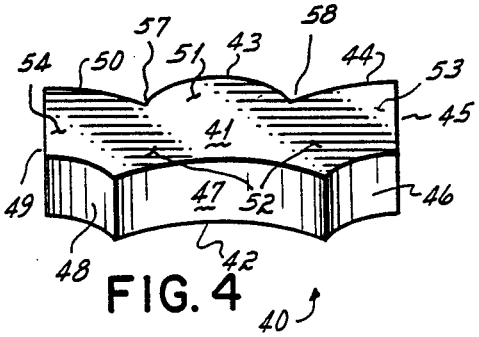
FIG. 4 is a perspective view of a paving stone for covering the ground and the like, according to another embodiment of the present invention, showing the top and inside concave curved side thereof.
Figure 5:
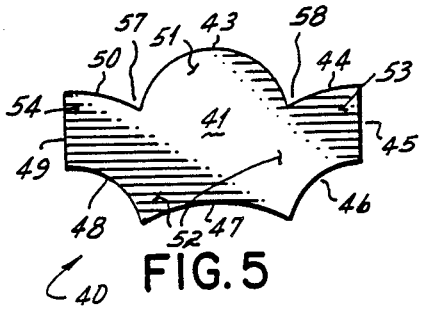
FIG. 5 is a top plan view of the paving stone of FIG. 4.
Figure 6:
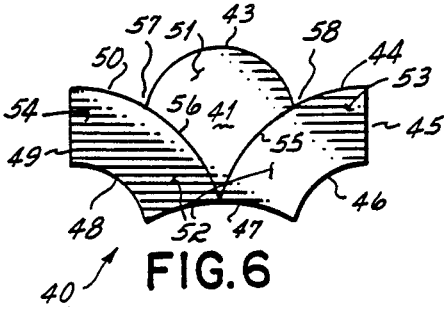
FIG. 6 is a top plan view of the paving stone of FIG. 4, according to still further embodiment which is an alternative to that of FIG. 5, which includes a false joint in the top thereof.

Other alternative embodiments to the stone of FIGS. 1–3 are those illustrated in FIGS. 4-6. Referring to FIGS. 4–6, a stone 40 is shown having an upper surface 41, a lower surface 42, and eight vertical side surfaces 43–50. Six of the side surfaces, surfaces 43, 44, 46–48 and 50, are segments of the surfaces of vertical cylinders and appear as arcs of circles in the top views of FIG. 5. The arc of side surface 43 is convex and a circular arc of a first and lesser radius. The arc of side surfaces 46 and 48 are concave curves of radius and combined length equal to that of the arc of surface 43. The arcs of side surfaces 44, 47 and 50 are the arcs of circles of a second radius larger than, and preferably twice, the lesser radius. The arcs of side surfaces 44 and 50 are convex and have a combined length equal to the arc of side surface 47. As such, when assembly in a ground cover pattern, the side surface 43 is capable of fitting against surfaces 46 and 48 of two adjacent stones while the surface 47 is capable of fitting against the surfaces 44 and 50 of two other adjacent stones. Sides 45 and 49 are each rectangular and planar, and equal in size so that a side 44 is capable of fitting against the side 50 of an adjacent stone. This will be better seen in FIG. 8 described below.

The edges of the stone 40 are preferably beveled at the junctions the surface 41 with the sides 43, 44, 46, 47, 48 and 50 (not shown). Preferably also, the stones 40 are not beveled at the top edge of the vertical side 45 and 49 so that the joints between those surfaces and the planar surfaces 49 and 45 of adjacent stones are less prominent than the others when the stones are arranged in a ground cover pattern.

The vertical sides 43, 46 and 48 are of the shorter of the two radii described in connection with FIGS. 1–3. Sides 44, 47 and 50 are also of the same radius, which is the larger of the two radii described in connection with FIGS. 1–3 above.

In the alternative embodiment of FIG. 6, the stone 40 is identical in all respects to that of FIG. 5 except that there are provided a pair of false joints in the surface 41 thereof which are respectively extensive of the arcs of sides 50 and 44. The grooves 57 and 58 may also be formed of V-grooves to match the edge bevels of the other arcs when provided.

As with the stone 20 of FIGS. 1–3, the top surface 41 of stones 40 of FIGS. 4-6 may be viewed as made up of two portions, a circular disk section 51 and an annular ring section 52. The disk section 51 is identical to the disk section 36 of FIG. 3. However, the ring section 52 of the surface 41 is formed in two parts (better seen by false joints 55, 56 shown in FIG. 6). The two parts include one ring section portion 53 and another ring section portion 54. The ring section portions 53 and 54 are such that, when two stones 40 are arranged in a pattern with the surface 45 of the ring section portion 53 of one stone 40 set with the surface 45 against the surface 49 of the ring section portion 54 of an adjacent stone 40, a combined shape will be formed of the abutting portions 53 and 54 of the adjacent stones. This combined shape formed by patterns 53 and 54 is identical to the ring section 32 of the surface 21 of the stone 20 in FIG. 3. The ring section portions 53 and 54 abut the section 51 and are integrally formed therewith at the false joints 55 and 56.

All of the angles at which the adjacent side surfaces of the stone 40 of FIGS. 4–6 form are exterior angles with the exception of the angle 57 between the sides 50 and 43 and the angle 58 between sides 43 and 44. The angles of the portions 53 and 54 of surface 51, considered separately, are all exterior angles.

Figure 7:
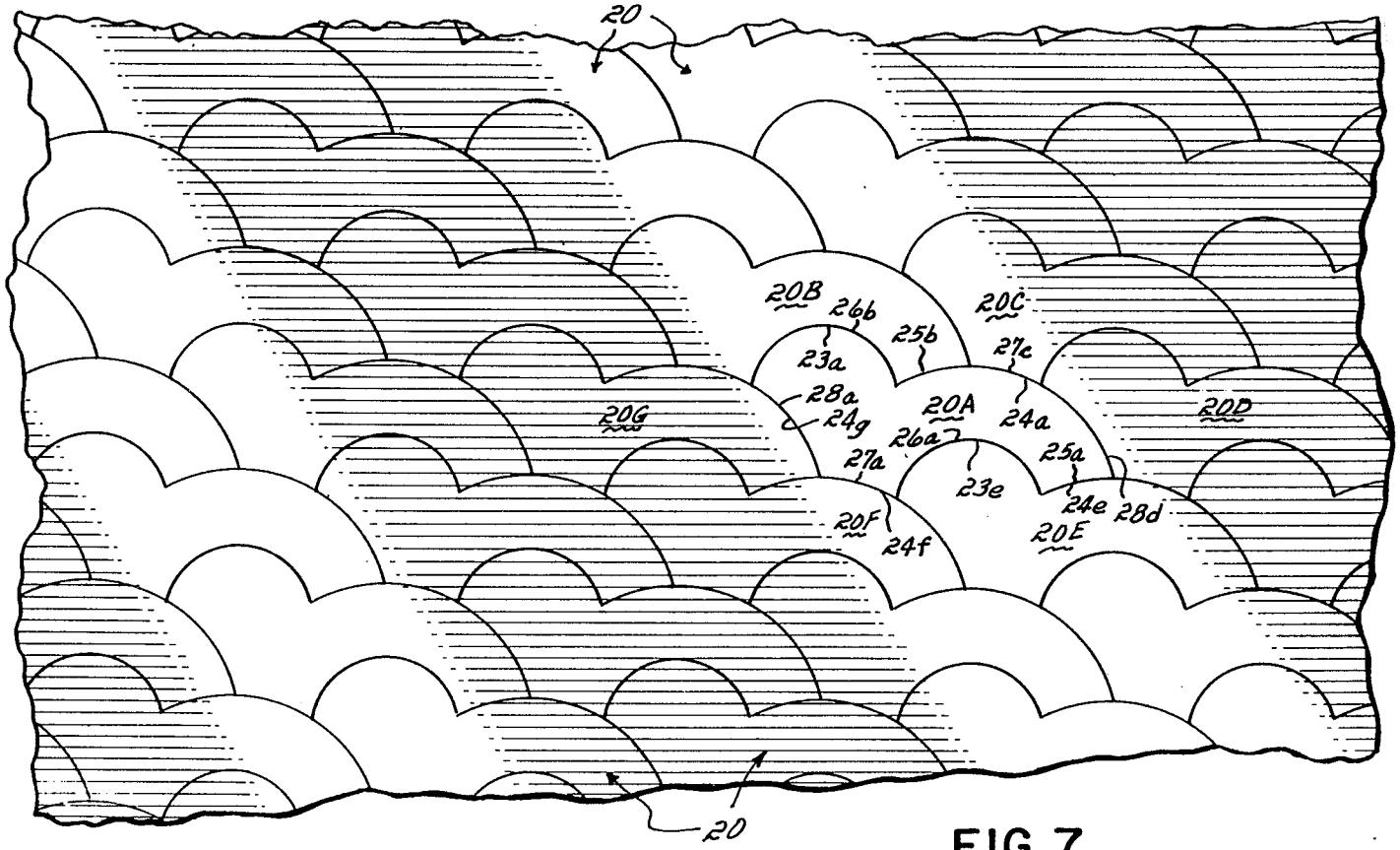
FIG. 7 is a plan view of a ground covering arrangement using paving stones of FIGS. 1–3.

A plurality of stones 20 of the embodiment of FIG. 1 are arranged, in a preferred embodiment of the invention, in a ground cover pattern as shown in FIG. 7. In the pattern of FIG. 7, the stone labeled 20A is completely surrounded by a set of six identical and similarly oriented stones 20B–20G. The sides of the stone 20A are labeled in FIG. 7 as the surfaces 23a–28a. Corresponding side surfaces of the adjacent stones 20B–20G are similarly labeled with a number corresponding to the side of the stone 20 with a letter appended corresponding to the letter designation of the stone 20B–20G in FIG. 7. Accordingly, it can be seen from FIG. 7 that the sides 23a of the stone 20A is adjacent the side 26b of the stone 20B. The side 25b of the stone 20B is adjacent the side 24a of the stone 20A as is the side 27c of the stone 20C and the side 28d of the stone 20D, the lengths of sides 25b, 27c and 28d equalling the length of side 24a. Similarly, the side 25a of stone 20A is adjacent a portion of the side 24e of stone 20B, the side 27a of the stone 20A is adjacent side 24f of stone 20F and the side 28a of the stone 20A is adjacent side 24g of the stone 20G. The side 26a of the stone 20A is adjacent side 23e of the stone 20E.

Figure 8:
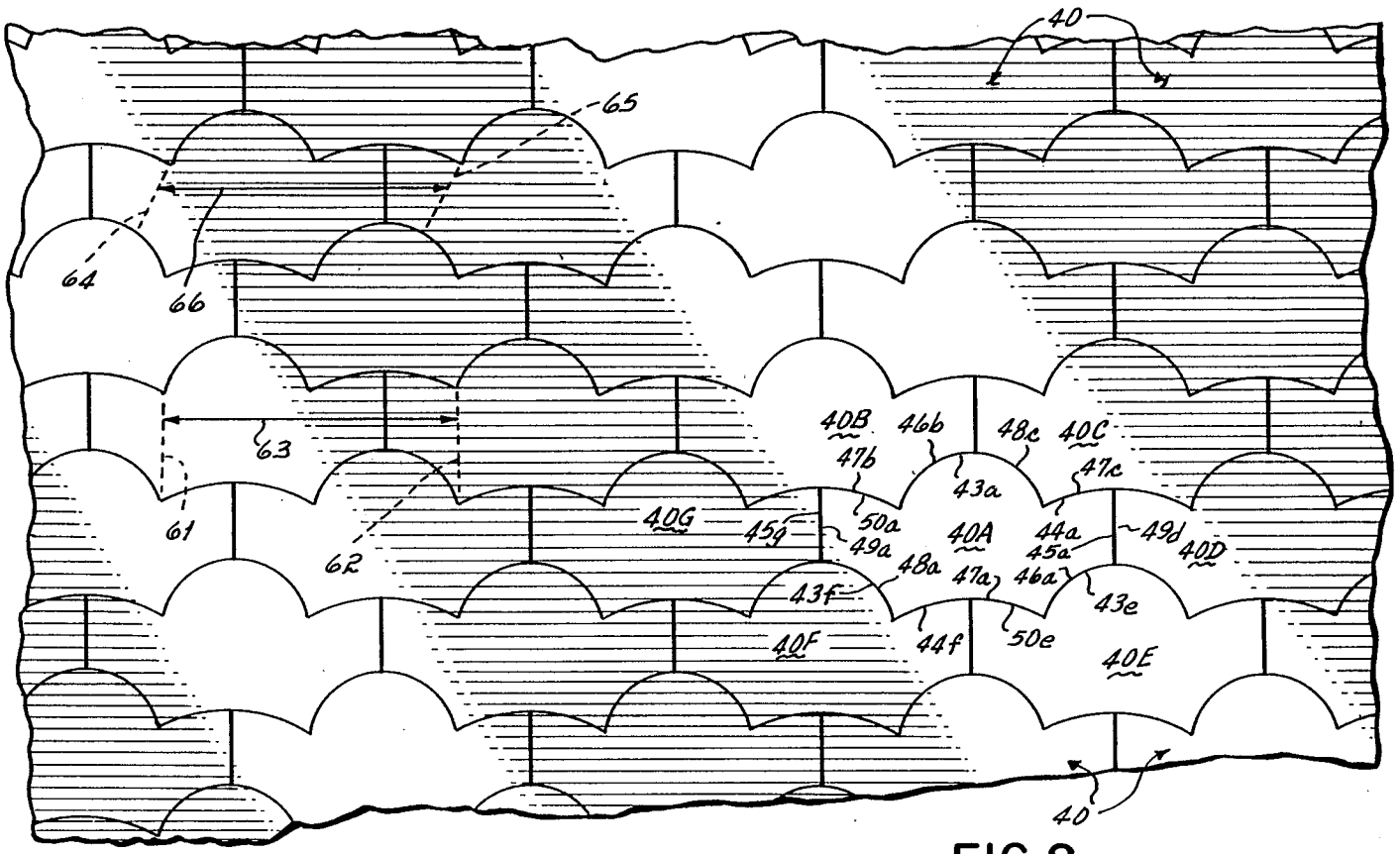
FIG. 8 is a plan view of a ground covering arrangement using paving stones of FIGS. 4–6.

Similarly, a plurality of the stones 40 of the embodiments of FIGS. 4–6 may be similarly oriented and arranged to form a complete ground cover pattern as shown in FIG. 8. One such stone 40A is completely surrounded by six identical and similarly oriented stones 40B–40G with a portion of the side 43a of the stone 40A adjacent a side 46b of the stone 40B and the portion of the side 43a is adjacent the side 48c of the stone 40C, the length of the sides 46b and 48c equalling that of sides 43a. The side 44a of the stone 40A is adjacent a portion of the side 47c of the stone 40C while the side 50a of the stone 40A is adjacent another portion of the side 47b of the stone 40B. Similarly, the side 47a of the stone 40A is adjacent the back side 50e of the stone 40E and the side 44f of the stone 40F, the combined length of the sides 44f and 50e equalling that of the side 47a. The side 46a of stone 40A is adjacent a portion of side 43e of the stone 40E, and the side 48a of stone 40A is adjacent a portion of the side 43f of the stone 40F. The side 45a of the stone 40A is adjacent the side 49d of the stone 40D and the side 49a of the stone 40A is adjacent the side 45g of the stone 40G.

As a further embodiment of the stone 40, it is contemplated that the ring section 52 (FIG. 6) may be divided other than into two equal parts (as the portions 53 and 54 divide the section 51). For example, the section 51 may be divided by sides 61 and 62 (FIG. 8) replacing the sides 45 and 49 respectively, of the stone 40 to form a stone 63, or by sides 64 and 65 so positioned as shown in FIG. 8 to replace sides 45 and 49 so as to form a stone 66.

Figure 9:
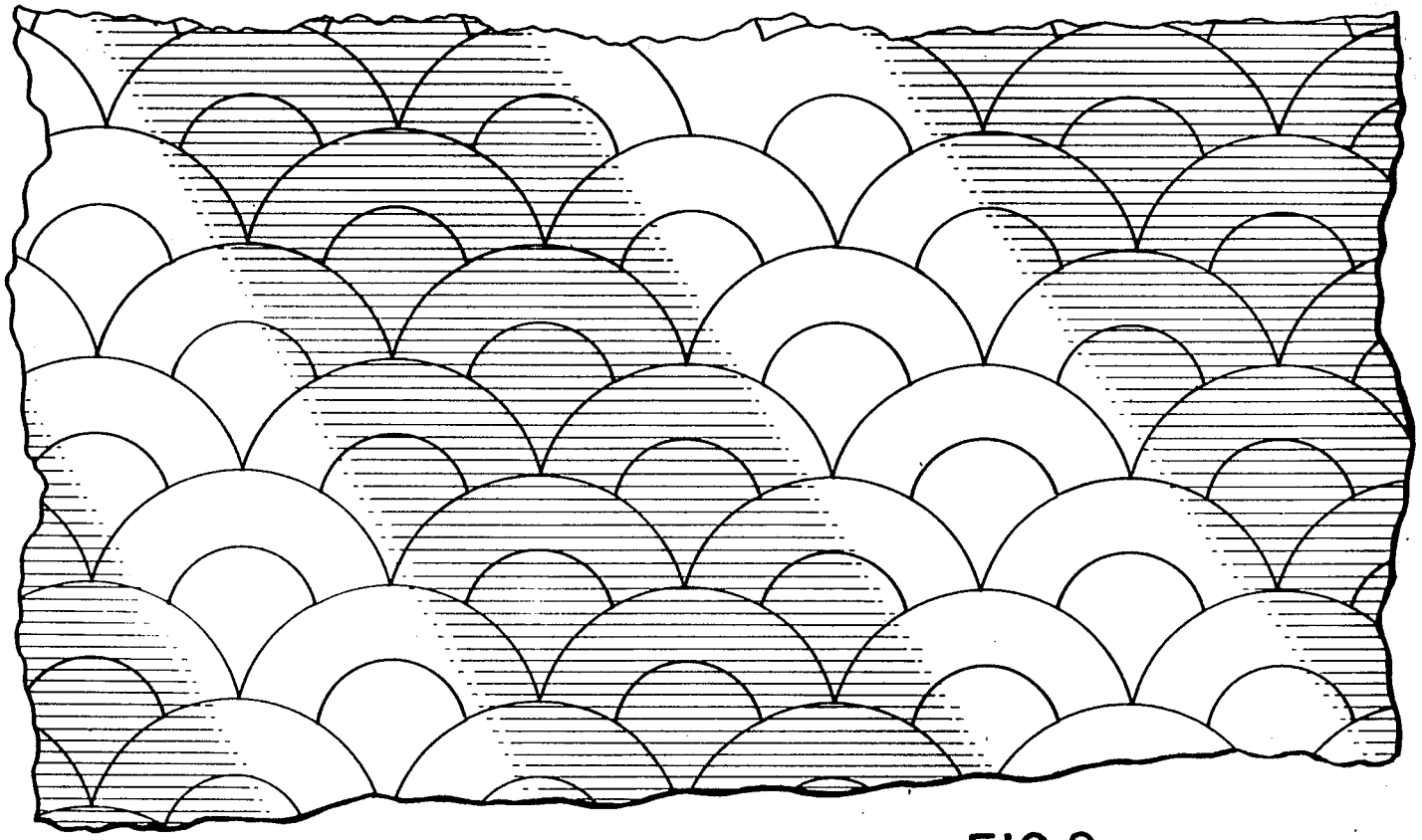
FIG. 9 is a plan view illustrating the appearance of the ground cover patterns formed by the ground covering arrangements of FIGS. 7 and s using paving stones of either FIGS. 1–3 or 4–6, particularly the stones of FIGS. 3 and 6, with the curved edges and false joints of the stones grooved or otherwise enhanced, but with no enhancement of the straight edges of the stone of FIG. 6.

Both of the stone arrangement patterns shown in FIGS. 7 and 8, when utilized with the respective stones of FIGS. 3 and 6, with edges beveled and false joints as described above, will form a pattern having the appearance shown by the pattern of FIG. 9. With the stone 40, this will be the case where all of the arc edges and false joints are prominently beveled while the edges formed on the top surfaces 41 with the planar sides 45 and 49 are not beveled and relatively inconspicuous.

Figure 10:
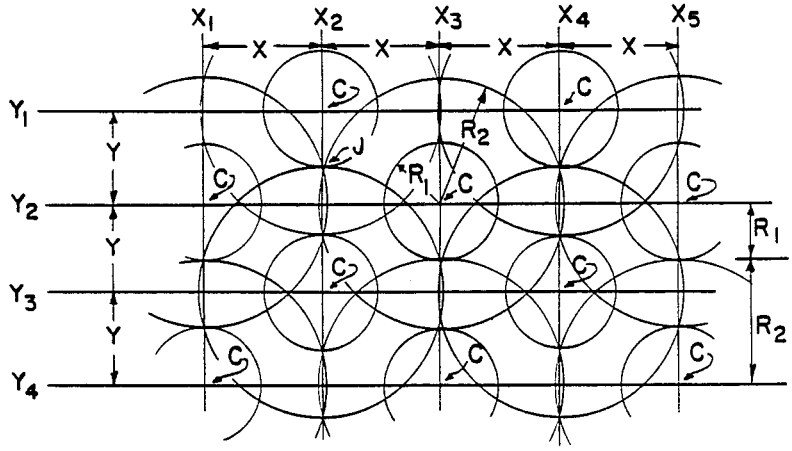
FIG. 10 is a diagram illustrating the grid pattern of the circles out of which the preferred embodiments of the stones of FIGS. 1–6 are formed.

The preferred dimensions for construction of stones in accordance with the preferred embodiments of the invention described above are explained in connection with the diagrams of FIGS. 10–12. Referring to FIG. 10, the design of the stones 20 and 40 is achieved by first setting out a rectangular grid having columns spaced a distance X and rows spaced a distance Y. A preferred ratio of X to Y is 4:3 in the preferred embodiments of the invention. The stones 20 and 40, in accordance with the present invention, will have, in their preferred form, a width of 2X in one direction and a width Y in the other. The stones will be laid out in rows at intervals a distance 2X. The columns of alternate rows are offset a distance X from each other so that the stones along the odd rows, for example, will align midway between the stones of the even rows.

Preferably, the stones are formed of concentric pairs of circles scribed about centers located at distances 2X along each of the rows and 2Y along each of the columns. The columns are a distance X apart with the odd columns offset a distance Y from the even columns. Correspondingly, the rows may be viewed as spaced a distance Y apart with the odd rows offset a distance X from the even rows. The centers around which the circles are scribed are indicated at points C in FIG. 10. The pairs of concentric circles scribed about each point are identical, each with an inner circle of a first radius $R_1$ and an outer circle of a larger radius $R_2$. Preferably, $R_1$ is approximately equal to ½ of $R_2$. It is also desirable that, in each column, the outer circles be tangent to the adjacent inner circles of the adjacent pair such that $R_1+R_2$ will equal 2Y. It is also desirable that the outer circles have a radius $R_2$ which is slightly greater than the distance X, at least sufficiently greater than the distance X so that adjacent circles of radius $R_2$ on the same row will intersect each other within the smaller circles on the intermediate columns as for example at point J in FIG. 10 where a circle of radius $R_2$ having a center at $X_1Y_2$ intersects the circle of radius $R_2$ having its center at $X_3Y_2$. It is, however, desirable that the outer circles be of a radius such that they will not intersect or surround the inner circles which are adjacent in the same rows. Accordingly, it is preferred that $R_2$ be greater than X but that X be less than ½ of the quantity $(R_1+R_2)$. In addition, it is preferred that $R_2$ be at least equal to the square root of the quantity $(X^2+(Y-R_1)^2)$. It is further desirable that $R_2$ be less than the quantity $(2Y-R_1)$.

Figure 11:
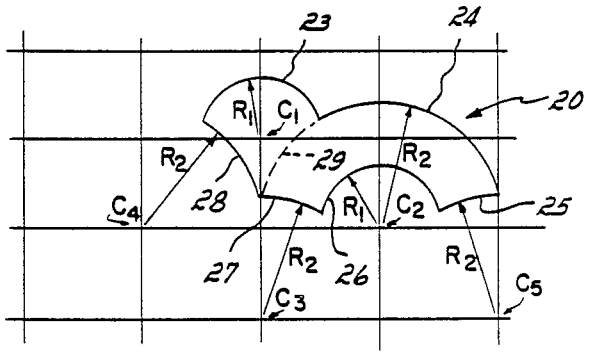
FIG. 11 is a diagram similar to FIG. 10 illustrating the stone of FIGS. 1–3.

Referring to FIG. 11, the stone 20 is illustrated on the grid of FIG. 10 formed by circles scribed about centers $C_1$, $C_2$, $C_3$, $C_4$ and $C_5$. The surface 23 lies on a circle of radius $R_1$ about center $C_1$. Surface 24 lies on a circle of radius $R_2$ about $C_2$. Side 25 is a portion of the circumference of a circle of radius $R_2$ about center $C_5$. Side 26 is defined by a circle of radius $R_1$ about center $C_2$. Side 27 is defined by a circle of radius $R_2$ about center $C_3$ and side 28 is defined by a circle of radius $R_2$ about center $C_4$. Where provided, the false joint 29 lies on the circle defined by the radius $R_2$ about center $C_2$.

Figure 12:
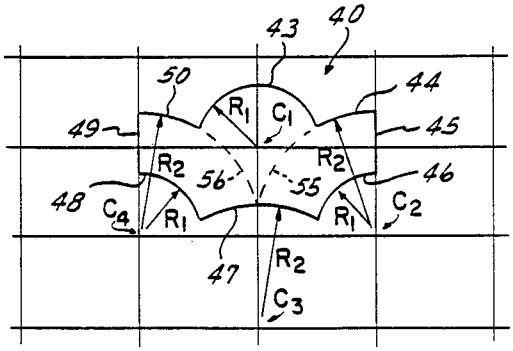
FIG. 12 is a diagram similar to FIG. 10 illustrating the stone of FIG. 4–6.

Referring to FIG. 12, the stone 40 is shown as being formed by side 43 defined by a circle of radius $R_1$ about center $C_1$, side 44 being formed by a circle of radius $R_2$ about center $C_2$, by side 46 formed by a circle of radius $R_1$ about center $C_2$, by side 47 being formed by a circle of radius $R_2$ about center $C_3$, by side 48 being formed by a circle of radius $R_1$ about center $C_4$, and by side 50 being formed by a circle of radius $R_2$ about center $C_4$, and by a pair of planar sides 45 and 49 which bisect rings or otherwise divide rings formed by a pair of concentric circles of radii $R_1$ and $R_2$ about center points $C_2$ and $C_4$, respectively.

It should be appreciated from the above description that the circular shapes, while ideally mathematical circles, may be of other generally circular shapes, such as elipses or irregular closed curves. Such generally circular shapes should nonetheless be the same in size, shape and orientation, such that all of the smaller ones are identical and all of the larger of the two are identical.

Figure 13:
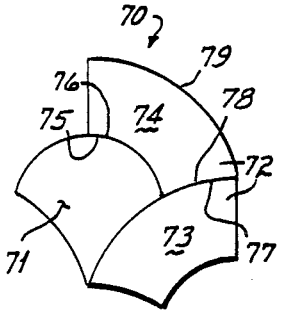
FIG. 13 is a view similar to FIG. 6 illustrating an alternative embodiment of a paving stone similar to the embodiments of FIGS. 4–6, 8 and 12.

Referring to FIG. 13, an alternative to the embodiment of FIGS. 4–6 is shown in which a stone 70 made up of two integral sections including a circular disk section 71 and a ring section 72, similar to the sections 51 and 52 of FIGS. 4–6, but in which two portions 73 and 74 of the ring section 72 abut the circular section 71 with the side of lesser radius concave boundary 75 adjacent to a half of the outer convex circular boundary 76 of a lesser radius of the circular section 72 and a larger radius concave boundary 77 of portion 74 of the ring section 72 adjacent a larger radius convex boundary 78 of the other portion 73 of the ring section 72, thereby forming a more compact, less elongated stone having certain structural and load bearing advantages. In this embodiment, the outer larger radius boundary 79 lies on a cylinder having an axis the same as that of the cylinder on which lies the outer boundary 76 of the circular section 71.

Figure 14:
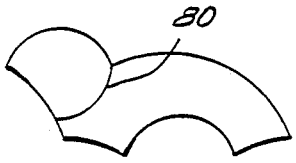
FIG. 14 is a view similar to FIG. 3 illustrating another alternative embodiment of the invention.

The alternative embodiment of FIG. 14 illustrates the use of false joints 80 in such a way as to modify the overall appearance of the patterns formed with the stones by placing them other on the lines between circular boundaries of circular and annular sections of the stone.

Having described the preferred embodiments of the invention in terms of the surfaces, the component sections and also the circles out of which the stones may be formed, and in terms of the ground cover pattern formed by the stones, what is claimed is:

I claim:

1. A paving stone comprising:

a single piece of material having a plurality of integral sections including:

a first section formed of a segment of the solid lying within a first, generally cylindrical closed curved surface having a first radius and centered about a first axis, and a second section formed of an open segment of a first annular ring;

said first annular ring lying between and bounded in part by:

a second generally cylindrical curved surface having a second radius greater than said first radius and centered about a second axis spaced from said first axis, and a third generally cylindrical curved surface identical to said first surface and having a third radius equal to said first radius and centered about a third axis coincident with said second axis; and said first surface intersecting said second surface, said first section abutting said second ion at said second surface and lying between and bounded at least in part by said first surface and said second surface.

2. The paving stone of claim 1 wherein:

said second section lies outside of and is bounded in part by a fourth generally cylindrical closed curved surface which intersects said second and third surfaces, is identical to said second surface, has a fourth radius equal to said second radius and is centered about a fourth axis spaced from said first and second axes.

3. The paving stone of claim 2 wherein:

said second section lies outside of and is bounded in part by a fifth generally cylindrical closed curved surface which intersects said second and third surfaces, is identical to said second surface, has a fifth radius equal to said second radius and is centered about a fifth axis spaced from said first, second and fourth axes.

4. The paving stone of claim 3 wherein:

said first section lies outside of and is bounded in part by a sixth generally cylindrical closed curved surface which intersects said first surface, is identical to said second surface, has a sixth radius equal to said second radius and is centered about a sixth axis spaced from said first and second axes, and said second axis is equidistant from said fourth and fifth axes, and the distance of said second axis from said sixth axis is equal to the distance of said fourth axis from said fifth axis.

5. The paving stone of claim 2 wherein:

said second axis is equidistant from said first and fourth axes.

6. The paving stone of claim 5 wherein:

the sum of said first and second radii equals the distance between said first and fourth axes.

7. The paving stone of claim 2 wherein:

said first section lies outside of and is bounded in part by a sixth generally cylindrical closed curved surface which intersects said first surface, is identical to said second surface, has a sixth radius equal to said second radius and is centered about a sixth axis spaced from said first and second axes, and said second and said sixth axes are each equidistant from said first and fourth axes.

8. The paving stone of claim 1 wherein:

said first section lies outside of and is bounded in part by a sixth generally cylindrical closed curved surface which intersects said first surface, is identical to said second surface, has a sixth radius equal to said second radius and is centered about a sixth axis spaced from said first and second axes.

9. The paving stone of claim 8 wherein:

the distance from said second to said sixth axes is less than twice said second radius and more than the sum of said first and second radii.

10. The paving stone of claim 8 wherein:

the square of said second radius is greater than or equal to the sum of the squares of:

half the distance from said second to said sixth axes, and half the sum of said first and second radii, minus said first radius.

11. The paving stone of claim 8 wherein:

said second section is further formed of an open segment of a second annular ring; and said second annular ring lies between and is bounded in part by:

said sixth surface, and a seventh generally cylindrical curved surface identical to said first surface, having a seventh radius equal to said first radius and centered about a seventh axis coincident with said sixth axis.

12. The paving stone of claim 11 wherein:

said second section lies outside of an eighth generally cylindrical closed curved surface which intersects said second, third, sixth and seventh surfaces, is identical to said second surface, has an eighth radius equal to said second radius and is centered about an eighth axis spaced from said first, second and sixth axes.

13. The paving stone of claim 12 wherein:

said second and sixth axes are each equidistant from said first and eighth axes.

14. The paving stone of claim 12 wherein:
the sum of said first and second radii equals the distance between said first and eighth axes.

15. The paving stone of claim 12 wherein:
said second and said sixth surfaces intersect on or within said first surface.

16. The paving stone of claim 15 wherein:
said eighth circuit intersects said second and sixth surfaces on or within said first surface.

17. The paving stone of claim 11 Wherein:
said second and said sixth surfaces intersect on or within said first surface.

18. The paving stone of claim 11 wherein each of said annular rings is bounded by at least one planar surface.

19. The paving stone of claim 3 wherein:
said first section lies outside of a sixth generally cylindrical closed curved surface which intersects said first surface, is identical to said second surface, has a sixth radius equal to said second radius and is centered about a sixth axis spaced from said first and second axes.

20. The paving stone of claim 2 wherein:
the sum of said first and second radii equals the distance between said first and fourth axes.

21. The paving stone of claim 1 wherein:
said second section is further formed of an open segment of a second annular ring; and
said second annular ring lies between and is bounded in part by said first surface and a ninth generally cylindrical closed curved surface which is identical to said second surface, has a ninth radius equal to said second radius and is centered about a ninth axis coincident with said first axis.

22. The paving stone of claim 21 wherein each of said annular rings are bounded by at least one planar surface.

23. The paving stone of claim 19 wherein:
said second section lies between a pair of generally planar surfaces which intersect said second and third surfaces.

24. The paving stone of claim 1 wherein:
said second section lies between a pair of generally planar surfaces which intersect said second and third surfaces.

25. An curvilinear paving stone capable of being combined in an interlocking pattern with a plurality of similarly shaped paving stones to form a ground cover completely covering the surface of the ground, said stone comprising:
a single piece of molded concrete material having an upper surface, a lower surface and a plurality of at least six vertical side surfaces each extending between the top and bottom surfaces and each having a pair of opposite vertical edges each joining a vertical edge of another of said side surfaces at an angle;
said plurality of side surfaces including at least four curved surfaces each of which lies on a surface of a cylinder having a vertical axis, and at least two of said curved side surfaces being concave and at least two being convex, at least one of each concave surface and at least one of each convex surface having a radius $R_1$ and at least one of each concave surface and at least one of each convex surface having a radius $R_2$ greater than the radius $R_1$, the sums of the lengths of the concave surfaces of each radius being equal to the sums of the lengths of the convex surfaces of the same radius.

26. A paving material for forming a ground cover comprising:
a plurality of paving stones, each identical in shape and each formed of a single piece of material, the shape of each stone being defined in part at least by a plurality of side surfaces capable of forming an abutting relationship with the side surfaces of adjacent ones of said stones when arranged in a ground cover pattern;
the plurality of said side surfaces including a plurality of curved surfaces defined by the arcs of circles of a plurality of pairs of concentric circles, each pair including an inner circle of a lesser radius and an outer circle of a greater radius, laid out in an array of centers each located at a point of intersection of lines of two sets, the lines of each set being parallel and equally spaced;
the radii of said circles being such that adjacent circles of the array have one or more common points, thereby defining cylindrical segments of solid cylinders of said lesser radius and segments of annular rings bounded by the surfaces of cylinders of an inner radius equal to said lesser radius and an outer radius equal to said outer radius;
each stone being formed of one solid cylindrical segment and at least one annular segment, said solid segment being integrally joined with said annular segment at a surface of said outer radius;
each stone thereby having at least one convex side surface of the lesser radius bordering the solid cylindrical segment thereof, a concave side surface of said lesser radius bordering an annular segment thereof, and at least one convex side surface thereof of the greater radius bordering an annular segment thereof and at least one concave side surface of the greater radius;
the combined lengths of the concave side surfaces of each stone which are of the same radius equalling the combined lengths of the convex side surfaces of the stone which are of the same radius.

27. A ground cover formed of the paving material of claim 26 comprising:
a plurality of said stones, each similarly oriented and each set in the same unique position with respect to a different one of the intersection points of said array, and each abutting others of said stones positioned at adjacent with respect to adjacent points of said array so that all of said side surfaces are in abutment with side surfaces of adjacent stones.

28. The ground cover of claim 27 wherein:
each of said stones has an upper surface having thereon a false joint which is an arc of a circle of said second radius which lies on the boundary between said the cylindrical segment thereof and an annular segment thereof.

29. The paving material of claim 26 wherein:
each of said stones has an upper surface having thereon a false joint which is an arc of a circle of said second radius which lies on the boundary between said the cylindrical segment thereof and an annular segment thereof.

30. The paving material of claim 26 wherein:
each of said stones has an upper surface having thereon at least one false joint which lies other than on the boundary between said the cylindrical segment thereof and an annular segment thereof.

* * * * *

UNITED STATES PATENT AND TRADEMARK OFFICE

CERTIFICATE OF CORRECTION

PATENT NO. : 4,973,192

DATED : November 27, 1990

INVENTOR(S) : Roberta A. Hair

It is certified that error appears in the above-identified patent and that said Letters Patent is hereby corrected as shown below:

Column 3, line 18 "R" should be --$R_1$--.

Column 3, line 60 "s" should be --8--.

Column 9, line 52 "ion" should be --section--.

Signed and Sealed this

Twenty-eighth Day of April, 1992

*Attest:*

HARRY F. MANBECK, JR.

*Attesting Officer*

*Commissioner of Patents and Trademarks*